US005435355A

United States Patent [19]

Xiao

[11] Patent Number: 5,435,355

[45] Date of Patent: Jul. 25, 1995

[54] CONICAL FLOATING TYPE FUEL FILLING DEVICE

[76] Inventor: Yong Xiao, c/o Juying Zhu Shan-shang Transport Station Jiang-xin Iron and Steel General Works, Xinyu, Jiangxi 336513, China

[21] Appl. No.: 134,222

[22] Filed: Oct. 8, 1993

[30] Foreign Application Priority Data

Oct. 9, 1992 [CN] China ..... 92238236.0
Sep. 29, 1993 [CN] China ..... 93118658.7

[51] Int. Cl.[6] ..... B67C 3/00

[52] U.S. Cl. ..... 141/26; 73/864.11; 422/100

[58] Field of Search ..... 141/23, 24, 25, 26, 141/27, 28; 73/864.11, 864.01; 422/100, 99

[56] References Cited

U.S. PATENT DOCUMENTS

| | | | |
|---|---|---|---|
| 2,795,245 | 6/1957 | Meehan | 141/26 |
| 3,158,183 | 11/1964 | Brown et al. | 141/24 |
| 3,285,296 | 11/1966 | Ishimaru | 141/26 |
| 3,312,255 | 4/1967 | Miller | 141/24 |
| 4,463,616 | 8/1984 | Blecher | 73/864.11 |
| 4,671,330 | 6/1987 | Miles | 141/24 |
| 5,104,624 | 4/1992 | Labriola | 422/100 |

FOREIGN PATENT DOCUMENTS

| | | | |
|---|---|---|---|
| 946110 | 1/1964 | United Kingdom | 141/24 |
| 9105609 | 5/1991 | WIPO | 141/25 |

*Primary Examiner*—J. Casimer Jacyna
*Assistant Examiner*—Steven O. Douglas
*Attorney, Agent, or Firm*—Merchant, Gould, Smith, Edell, Welter & Schmidt

[57] ABSTRACT

The present invention relates to a conical floating type fuel filling device which comprises a hollow rubber ball, a mating seat, an I-shaped body member, a sleeve, a floating cylinder and a conic-cylindrical casing. A movable stop is provided in an oblique shouldered passage of the I-shaped body member and a one-way air exhaust member is fitted over a downward vertically protruding portion extending from an end surface of the I-shaped body member in which portion is provided a small through hole. The floating cylinder includes a head and is disposed in the sleeve, and across the top end of the sleeve there is a groove defining two openings. The conic-cylindrical casing is screwed on the mating seat which is mounted to the rubber ball. The device can be used with conduits of different bores.

7 Claims, 3 Drawing Sheets

CONICAL FLOATING TYPE FUEL FILLING DEVICE

BACKGROUND OF THE INVENTION

The present invention relates to a fuel filling device, particularly to a conical floating type fuel filling device.

The conventional siphon-based fuel filling device mainly consists of a rubber ball with a valve disposed in a central passage of the ball, its two ends fixedly connected to a conduit.

The advantage of this kind of fuel filling device is that it is simple and convenient, but there are drawbacks with this device: (1) short service life, due to the fact that the fuel passes through the ball which will corrode and age the ball; when the fluid is of high corrosiveness, the process of corrosion and aging will be expedited; and (2) poor adaptability, because the conduit fixedly mounted on the fuel filling device has a bore of fixed diameter; therefore, the device can be only used for fixed flow capacity. When the bore of the container is smaller than that of the conduit of the refuelling device, or when different flow capacities are needed, the conventional fuel filling device is not suitable for the purpose.

SUMMARY OF THE INVENTION

The object of the present invention is to provide a conical floating type fuel filling device featuring long service life and good adaptability such that the device can be used with various conduits of different bores.

A conical floating type fuel filling device according to the present invention comprises: a hollow rubber ball with one end being open; a mating seat connected to the open end of the rubber ball with an axial passage in its center portion; a conic-cylindrical casing screwed on the mating seat, with the upper part of which being of cylindrical shape and having a small hole defined in its side wall, the lower part of the casing being of conical shape and having a small hole defined at the tip of the conical lower portion; an I-shaped body member having upper end surface abutting on a lower end surface of the mating seat, a sealing ring disposed between the I-shaped body member and the mating seat and defining a space in a central portion between the two end surfaces, a lower conic side wall of the I-shaped body member is abutted against the conic inner wall of the upper end of the conical portion, the gap between the conic inner wall and the conic side wall of the I-shaped body member being sealed with a sealing ring, the central portion of the I-shaped body member including an oblique shouldered passage, the shouldered passage having a conic seat formed at its lower end, the I-shaped body member further including a protruding portion extending therefrom and defining a passage through a portion of the body member communicating with the space (between the end surfaces of the body member and the mating seat) and an area between the body member and the hole in the conic-cylindrical casing; a movable stop is disposed in the oblique shouldered passage; a rubber one-way exhaust cylinder fitted over the free end of the protruding portion of the I-shaped body member and communicating with the passage in the protruding portion, a side wall of the air exhaust cylinder having a slit which is normally closed, the lower free end of the air exhaust cylinder being closed; a sleeve screwed on a lower end of the I-shaped body member and having a small hole defined on its side wall, and a groove is formed across the top end of the sleeve where the sleeve is connected to the I-shaped body member thus forming two openings which communicate the inside of the sleeve with the outside of the sleeve, and a floating cylinder with a conic head located in the sleeve, the conic head can block the conic seat at the lower end of the oblique shouldered passage in the I-shaped body member. In addition, at the open end of the rubber ball is provided a shouldered nut, the mating seat is mounted to the open end of the rubber ball by a hollow screw which threadably engages the shouldered nut through the axial passage in the mating seat.

Another structure of the conical floating type fuel filling device according to the present invention comprises: a hollow rubber ball with one end being open; a mating seat connected to the open end of the ball with an axial passage in its central portion; a conic-cylindrical casing screwed on the mating seat, with its upper part being of cylindrical shape and having a small hole defined in its side wall, the lower part of the casing being of conical shape and having a small hole defined at the tip of the conical lower part; a cylindrical one-way exhaust member, the upper end surface thereof abuts on the lower end surface of the mating seat, a sealing ring disposed between the air exhaust member and the mating seat and defining a space between the two end surfaces, the inside of the one-way exhaust member having a radial oblique shouldered passage in which a movable stop is disposed, an axial through-hole is formed through the exhaust member which is communicated with the oblique shouldered passage; a cylindrical body member, the upper end surface of which abuts on the lower end surface of the exhaust member a sealing ring disposed between the exhaust member and the cylindrical body member and defining a space between the two end surfaces, a lower side surface of the cylindrical body member abuts on the conic inner wall of the lower conic part of the conic-cylindrical casing, in the axial center of the cylindrical body member is provided an oblique shouldered passage, the shouldered passage having a conic seat formed at its lower end, a movable stop is disposed in the oblique shouldered passage; on the lower end of the cylindrical body member is screwed a sleeve having a small hole defined on its side wall, and across the top end of the sleeve where the sleeve is connected to the cylindrical body member is formed a groove defining two openings which communicate the inside of the sleeve with the outside of the sleeve; a floating cylinder with a conic head is located in the sleeve, the conic head can block the conic seat at the lower end of the oblique shouldered passage in the cylindrical body member. In addition, at the open end of the rubber ball is provided a shouldered nut, thereby the mating seat is mounted to the open end of the rubber ball by a hollow screw which threadably engages the shouldered nut through the axial passage in the mating seat.

BRIEF DESCRIPTION OF THE DRAWINGS

Now the embodiments of the present invention will be described in detail in conjunction with the accompanying drawings, in which.

DETAILED DESCRIPTION OF THE PREFERRED EMBODIMENTS

Figure 1:
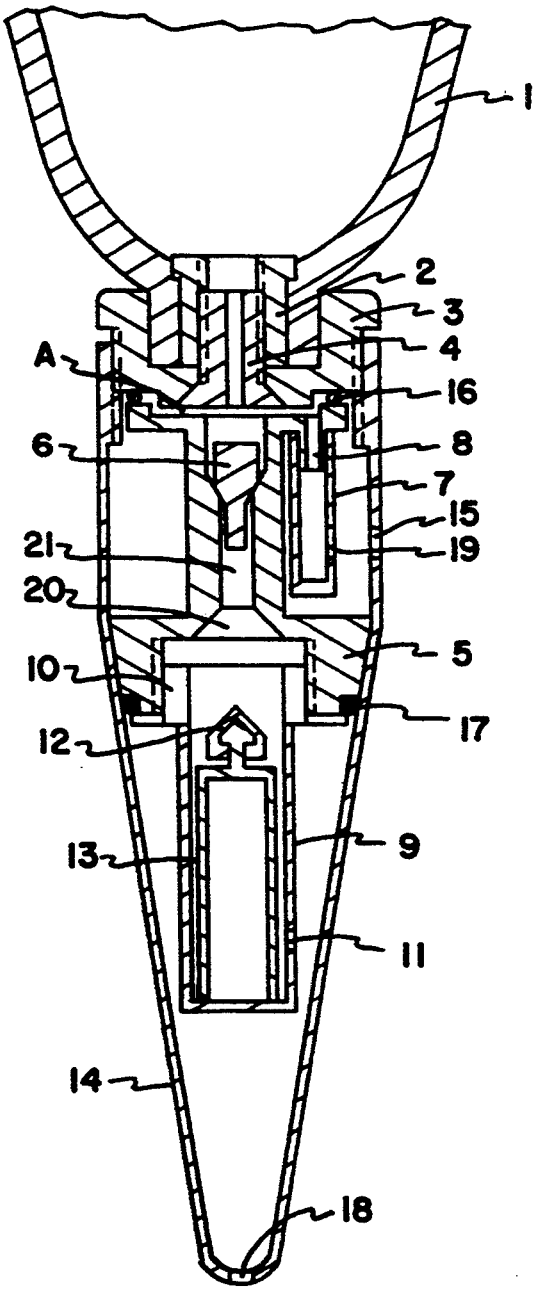
FIG. 1 shows a longitudinally sectioned view of the first embodiment according to the present invention.

Referring to FIG. 1, the first embodiment of the present invention is shown. At the open end of a hollow rubber ball 1 (only a part of it is shown in FIG. 1 ) is provided a nut 2 with a shoulder on the outer side of its upper end. The shoulder is disposed within the rubber ball 1 and is larger in diameter than the open end of the ball 1. A mating seat 3 engages the nut 2. In the central portion of the mating seat 3 there is an axial passage, and on the outer side of its upper end there is a shoulder while on the outer side of its lower portion, which is smaller in diameter, threads are defined. A hollow screw 4 is screwed into the nut 2 at the open end of the rubber ball 1 through the axial passage in the mating seat 3, thereby the mating seat 3 and the rubber ball are joined together. A conic-cylindrical casing 14 mates with the mating seat 3 and consists of an upper cylindrical part and a lower conical part with a small hole 18 defined at the tip of the conical part and a small hole 15 in the side wall of the cylindrical part. An I-shaped body member 5 is disposed within the conic-cylindrical casing 14. ("I-shaped" referring to a structure in which the upper and lower end portions have diameters greater than the diameter of the central portion therebetween.) The lower end of the I-shaped body member 5 takes the shape of a cone which is matched with the conical part of the conic-cylindrical casing, thereby its lower part can be abutted against the inner wall of the conical part of the conic-cylindrical casing. When the upper end of the conic-cylindrical casing is screwed on the outer threads of the mating seat 3, the bottom surface of the mating seat 3 is pressed downward on the upper surface of the I-shaped body member until the conical lower end of the I-shaped body member is pressed against the inner wall of the conical part of the conic-cylindrical casing and thus the I-shaped body member is sturdily fixed. A scaling ring 16 is disposed between the I-shaped body member and the mating seat. At this point, due to the presence of a sealing ring 17 located around the lower end of the I-shaped body member 5, the outer side of the conical lower end of the I-shaped body member is in airtight contact with the inner wall of the conic-cylindrical casing 14; meanwhile because of the presence of the sealing ring 16, there exists a space A between the upper end surface of the I-shaped body member and the lower end surface o f the mating seat 3 (including the end surface of the hollow screw 4). In the axial central portion of the I-shaped body member 5 is provided an oblique shouldered passage 21 in which a movable stop 6 is situated. The stop 6, which can move in an axial direction within the passage 21, can block the oblique shouldered passage 21 as shown in FIG. 1. At the lower end of the oblique shouldered passage 21 is a conic seat 20. A one-way air exhaust cylinder 7 is fitted over a downward protruding portion extending from a bottom surface of the upper portion of the I-shaped body member in which protruding portion is provided a small through hole 8, the inner chamber of the one-way air exhaust cylinder 7 is communicated with the space A through the small hole 8. The one-way air exhaust cylinder can be a rubber pipe with one end opened and the other end closed. On the rubber pipe an axially extending cut 19 is made with a knife or the like. When the one-way air exhaust cylinder 7 does not operate, the cut 19 is closed under the elastic force of the rubber itself, but when the air pressure within the one-way cylinder is higher than the pressure at the outside of the one-way cylinder, air will break through the cut 19 and flow out from the one-way cylinder, and when the air pressure inside the one-way cylinder is lower than or equal to the air pressure outside the one-way cylinder, the cut will be closed and no air flow will occur.

Figure 2:
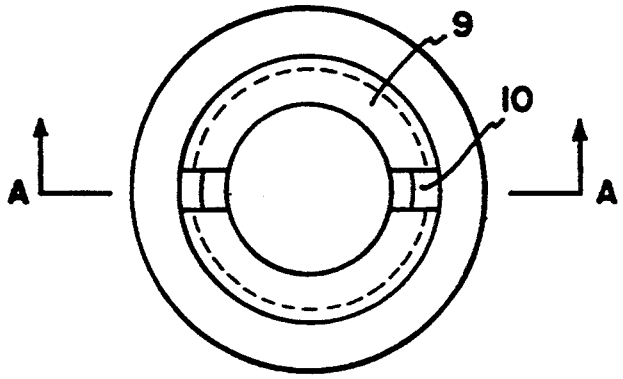
FIG. 2 shows a plan view of the conical-cylindrical casing of the embodiment illustrated in FIG. 1.
Figure 3:
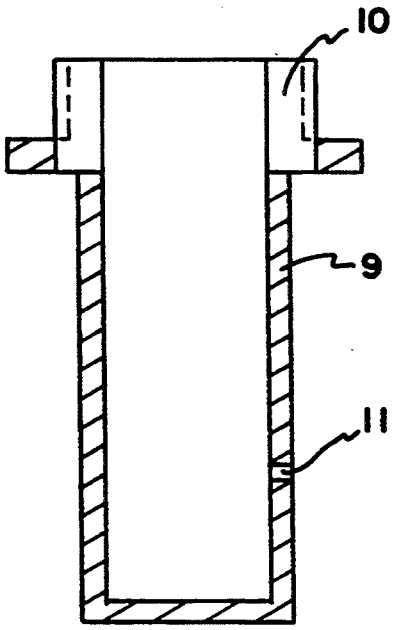
FIG. 3 is a sectional view through the A—A line of FIG. 2.

A sleeve 9 is mounted onto the lower end of the I-shaped body member 5. The outer surface of the upper end of the sleeve 9 (referring to FIG. 2 and FIG. 3 simultaneously) and a groove 10 is formed across the upper end of the sleeve, thus forming two openings therein. In the sleeve 9 is provided a floating cylinder 13 having a conic head 12 and a small hole 11 is defined in the side wall of the sleeve 9. The floating cylinder 13 may be made of light material such as plastic. The sleeve 9 is screwed onto the I-shaped body member. The space in the lower conical part of the conic-cylindrical casing 14 is communicated with the oblique shouldered passage 21 in the axial central portion of the I-shaped body member 5 via the hole 11.

The operation of the first embodiment of the present invention is as follows:

A conduit (not shown) is taken, one end of which is fitted over the outer surface of the conical part of the conic-cylindrical casing 14, the other end is put into the container (not shown) in which is contained oil or other fluid. Due to the fact that the lower end of the conic-cylindrical casing 14 is in the shape of a cone, conduits of different diameters can be fitted over it. Squeezing the rubber ball 1 by hand compresses the air within it: thus, the air is forced to flow through the central hole of the hollow screw, across the space A and into the oblique shouldered passage 21 of the I-shaped body member to push downwards the moveable stop 6 and thereby block the passage 21. The air is forced to change its direction and to flow into the air exhaust cylinder 7 through the space A and the small hole 8. The cut 19 is pushed open and the air breaks through it, into the area between the body member 5 and the conicalcylindrical casing 14, and finally passing through the small hole 15 of the coniccylindrical casing 14. Air flows out from the fuel filling device because the pressure in the air exhaust cylinder 7 is higher than the pressure outside the cylinder 7.

When loosening the grasp on the rubber ball 1, the air in the conduit passes through the small hole 18, into the conical part of the conical-cylindrical casing 14 and through the grooves 10 on the sleeve 9, into the oblique shouldered passage 21 of the I-shaped body member 5, pushes upward the moveable stop 6, flows through the hollow screw, and finally flows into the rubber ball 1. While the above process is repeated, the air in the conduit will be exhausted and the oil or other fluid in the container will flow into the fuel filling device through the small hole 18 and finally the oil will flow into the sleeve 9 through the small hole 11 and the grooves 10, and the floating cylinder 13 will be gradually moved upward until the conic head 12 of the floating cylinder 13 abuts against the conic seat 20 in the lower end of the oblique shouldered passage 21 of the I-shaped body member 5. At this point, the oil or other fluid in the container stops entering into the fuel filling device and the rubber ball 1 now is in underpressure state, indicating that the air in the conduit is exhausted completely and that the oil has filled the conduit. At this point, the end of the conduit at the fuel filling device is taken away from the fuel filling device, and the mouth (the free end) of the conduit is allowed to face downward and go below the level of the oil or other fluid in the container. In this way, the oil or fluid will flow out from the container continuously under the effect of siphonage to fill the oil tank of a car or the like. In addition, when the fuel filling device is in use, the closed end of the rubber ball must be kept up.

Figure 4:
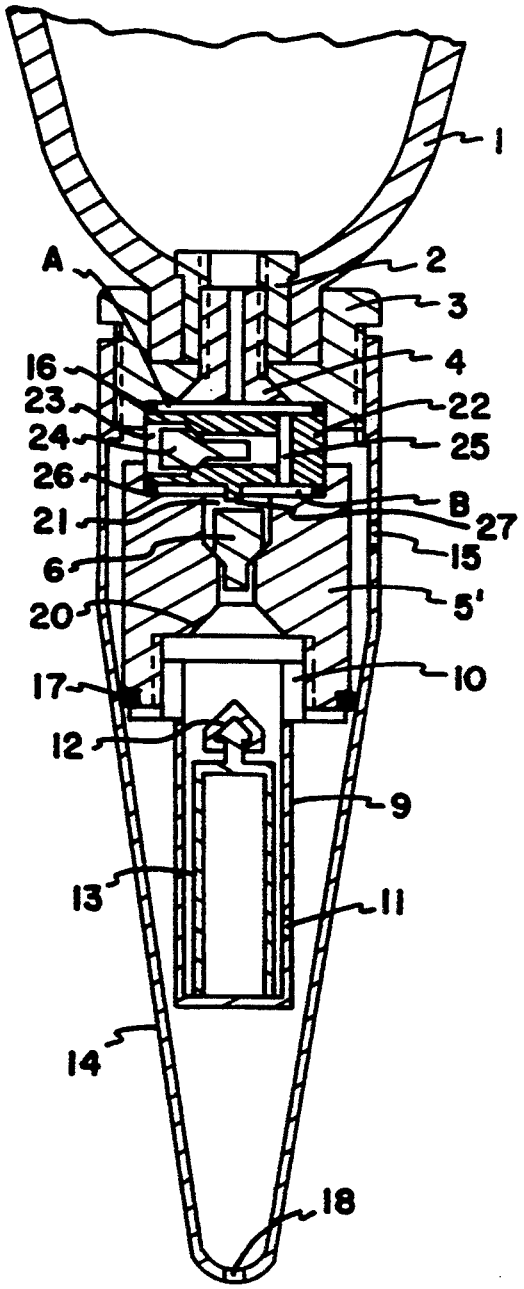
FIG. 4 is a longitudinal sectional view showing the second embodiment of the present invention.

Now referring to FIG. 4, the second embodiment of the present invention is shown. In the drawing, all components having the same structure as those in the first embodiment are denoted by the same reference numerals as those in the first embodiment. The difference lies only in that a cylindrical body member 5' is substituted for the I-shaped body member 5, wherein the small hole 8 and the one-way air exhaust cylinder 7 in the first embodiment are substituted by a cylindrical one-way air exhaust member 22 which is fixedly mounted between the mating seat 3 and the cylindrical body member 5' with the same manner as described in the first embodiment, a space A is defined between its axial upper end surface and the lower end surface of the mating seat 3 due to the presence of a sealing ring 16, and a space B is defined between its lower end surface and the upper end surface of the cylindrical body member 5' due to the presence of a sealing ring 26. There is a radial oblique shouldered passage 23 in the one-way air exhaust member 22 with a movable stop 24 being placed in the passage, said movable stop 24 may move along the passage 23 and can block it as shown in the drawing. In the one-way air exhaust member 22 there is a small axial hole 25 which not only is communicated with the oblique shouldered passage 23 but also communicates with spaces A and B. Moreover, at the central portion of the lower end surface of the one-way air exhaust member 22 there is formed a small protruding head 27 which, when the movable stop 6 moves upward, can abut against the stop's upper end surface so that the tipper end surface of the stop will not contact the lower end surface of the one-way air exhaust member 22.

The operation of the second embodiment of the present invention is fundamentally the same as that of the first embodiment. When the rubber ball 1 is compressed by the hand of the operator, the air in the rubber ball 1 passes through the central hole of the hollow screw 4, across the space A, through the axial small hole 25, across the space B and into the oblique shouldered passage 21, and pushes the movable stop 6 downwards which will block the oblique shouldered passage 21. The air is thereby forced to flow through the radial oblique shouldered passage 23, push away the movable stop 24, to flow into the area between the body member 5' and the conical-cylindrical casing 14, and finally to flow outside the fuel filling device through the small hole 15. When the rubber ball 1 is decompressed (loosening the grasp of it) the underpressure within the rubber ball 1 will suck air by the movable stop 24, through the central hole of the hollow screw 4, the space A, the axial small hole 25 and the radial oblique shouldered passage 23 to make the stop 24 move rightwards to the position (closed state) shown in FIG. 4, thereby blocking communication (through the small hole 15) with the atmosphere outside the fuel filling device. At this point, the air in the conduit passes through the small hole 18, into the conical part of the conical-cylindrical casing 14 and through the grooves 10 of the sleeve 9, into the oblique shouldered passage 21 in the cylindrical body member 5' and pushes the movable stop 6 upward, and then passes through the space B, axial small hole 25, the space A, the central hole of the hollow screw 4 and finally enters into the rubber ball 1. With the repetition of the above operation and utilizing the operation described in the first embodiment once the conduit is emptied of air, the same result as in the first embodiment can be readily achieved.

In the above-mentioned embodiments, except that the conic-cylindrical casing 14 is made of metallic material and that the floating cylinder and the movable stops must be made of plastic, all other components or parts can be made either of plastic or metallic materials.

The advantage of the present invention is that the conic-cylindrical casing can be used with conduits of different bores to meet the needs for different flow capacities and containers with different bores. Moreover, the conduits and the conic-cylindrical casing can mount or dismount freely. In addition, the ball itself and most components of the fuel filling device are isolated from the fluid, thereby corrosion will not be liable to occur and the service life can be substantially prolonged. Furthermore, the present fuel filling device is compact and easy to carry about.

I claim:

1. A conical floating type fuel filling device, comprising:

a hollow rubber ball (1) with one end being open; a mating seat (3) mounted on the open end of the rubber ball (1) and having an axial passage in its central portion; a conic-cylindrical casing (14) screwed on the mating seat (3) having an upper portion being cylindrical in shape and having a small hole (15) formed through the side wall of the upper portion, and having a lower portion being conic in shape with a small hole (18) formed through the tip end of the conic lower portion; an I-shaped body member (5) having an upper end surface abutting on a lower end surface of the mating seat (3), a sealing ring (16) disposed between the I-shaped body member and the mating seat and defining a space (A) between the two end surfaces, the I-shaped body member having a lower conical side wall abutting against the conical inner wall of the lower portion of the conic-cylindrical casing (14), the I-shaped body member having an axial central portion including an oblique shouldered passage (21); the shouldered passage having a conic seat (20) formed at its lower end, the I-shaped body member further including a protruding portion extending therefrom and defining a passage (8) through a portion of the body member communicating with space (A) and an area between the body member and the hole (15) in the conic-cylindrical casing, a movable stop (6) disposed in the oblique shouldered passage; a rubber one-way air exhaust cylinder (7) fitted over the free end of the protruding portion of the I-shaped body member and communicating with passage (8), a side wall of the air exhaust cylinder having a cut (19) being normally closed, the lower free end of the air exhaust cylinder (7) being closed; a sleeve (9) connected with a lower portion of the I-shaped body member (5) and having a small hole (11) defined in a side wall thereof, a groove (10) formed across the top end of the sleeve where it connects with the I-shaped body member (5) forming two openings in communication with the oblique shouldered passage and an area between the sleeve and the hole (18) in the conic-cylindrical casing; a floating cylinder (13) disposed in the sleeve (9) and having a head (12), the head being able to abut against the conic seat (20) at the lower end of the oblique shouldered passage (21) of the I-shaped body member (5).

2. A conical floating type fuel filling device as in claim 1, further comprising: a shouldered nut (2) in the open end of the rubber ball (1); and a hollow screw (4) threadably engaging the shouldered nut through the axial passage of the mating seat (3), there by mounting the mating seat (3) on the open end of the rubber ball (1).

3. A conical floating type fuel filling device as in claim 1, wherein the sleeve (9) is screwed on the lower portion of the I-shaped body member (5).

4. A conical floating type fuel filling device as in claim 1, wherein a sealing ring (17) is disposed between the lower conical side wall of the I-shaped body member and the conical inner wall of the lower portion of the conical-cylindrical casing (14).

5. A conical floating type fuel filling device as in claim 1, wherein the head (12) of the floating cylinder (13) is conical in shape.

6. A conical floating type fuel filling device comprising:

a hollow rubber ball (1) with one end being open; a mating seat (3) mounted on the open end of the rubber ball (1) and with an axial passage provided in its central portion; a conic-cylindrical casing (14) screwed on the mating seat (3) having an upper portion being cylindrical in shape and having a small hole (15) formed through the side wall of the upper portion, and having a lower portion being conical in shape with a small hole (18) formed through the tip of the conic lower portion; a cylindrical one-way air exhaust member (22) having an upper end surface abutting against a lower end surface of the mating seat (3), a sealing ring (16) disposed between the air exhaust member and the mating seat and defining a space (A) between the two end surfaces, the cylindrical one-way air exhaust member (22) having a radial oblique shouldered passage (23); a movable stop (24) disposed in the oblique shouldered passage, a small axial through hole (25) formed in the air exhaust member in communication with the oblique shouldered passage (23); a cylindrical body member (5'), having an upper end surface abutting against a lower end surface of the one-way air exhaust member (22), a sealing ring (26) disposed between the air exhaust member and the cylindrical body member and defining a space (B) between the two end surfaces, a lower side surface of the cylindrical body member abutting against the conical inner wall of the lower portion of the conic-cylindrical casing (14), the cylindrical body member having an axial central portion including an oblique shouldered passage (21); the shouldered passage having a conical seat (20) formed at its lower end, a movable stop (6) disposed in the oblique shouldered passage; a sleeve (9) mounted on a lower end of the cylindrical body member (5') and having a small hole (11) defined on a side wall thereof, and a groove (10) formed across the top end of the sleeve where it connects with the cylindrical body member forming two openings in communication with the oblique shouldered passage and an area between the sleeve and the hole (18); a floating cylinder (13) disposed in the sleeve (9) and having a head (12) which can abut against the conical seat (20) of the lower end of the oblique shouldered passage (21) of the cylindrical body member (5').

7. A conical floating type fuel filling device as in claim 6, further comprising: a shouldered nut (2) in the open end of the rubber ball (1); and a hollow screw (4) threadably engaging the shouldered nut through the axial passage of the mating seat (3), thereby mounting the mating seat (3) on the open end of the rubber ball (1).

* * * * *